US006425810B2

(12) United States Patent
Komuro

(10) Patent No.: US 6,425,810 B2
(45) **Date of Patent: *Jul. 30, 2002**

(54) POLISHING APPARATUS

(75) Inventor: Yoshiaki Komuro, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/188,354

(22) Filed: Nov. 10, 1998

(30) Foreign Application Priority Data

Nov. 11, 1997 (JP) ..... P9-308648

(51) Int. Cl.[7] ..... B24B 29/00
(52) U.S. Cl. ..... 451/289; 451/388
(58) Field of Search ..... 451/289, 287, 451/388, 398, 397, 288, 286, 285

(56) References Cited

U.S. PATENT DOCUMENTS 4,521,995 A * 6/1985 Sekiya ..... 51/235
5,423,716 A * 6/1995 Strasbaugh ..... 451/388
5,441,444 A * 8/1995 Nakajima ..... 451/289
5,645,474 A * 7/1997 Kubo et al. ..... 451/287
5,762,539 A * 6/1998 Nakashiba et al. ..... 451/41
5,851,140 A * 12/1998 Barns et al. ..... 451/288
5,938,512 A * 8/1999 Takei et al. ..... 451/388
6,030,488 A * 2/2000 Izumi et al. ..... 156/345
6,036,587 A * 3/2000 Tolles et al. ..... 451/288
6,050,880 A * 4/2000 Kato et al. ..... 451/41

* cited by examiner

*Primary Examiner*—Timothy V. Eley
*Assistant Examiner*—Dung Van Nguyen
(74) *Attorney, Agent, or Firm*—Sonnenschein, Nath & Rosenthal

(57) ABSTRACT

A polishing apparatus for polishing a subject surface of a thin-plate-like object that is held by a rotary polishing head with a polishing pad that is mounted on the surface of a rotary polishing surface table. The polishing head has sucking structures such as suction grooves and a through-hole. An elastic holding film that is formed with a plurality of through-holes are attached to the object holding surface of the polishing head. The object is polished in a state that it is sucked and held by the polishing head via the holding film by vacuum suction force.

12 Claims, 2 Drawing Sheets

POLISHING APPARATUS

BACKGROUND OF THE INVENTION

The present invention relates to a polishing apparatus which can polish a wide-area subject surface of a thin-plate-like object such as a semiconductor wafer or a glass plate for an LCD with a high degree of uniformity in the subject surface that is as close to the uniformity of an ideal surface standard as possible.

First, a conventional polishing apparatus will be described with reference to FIG. 1. FIG. 1 is a sectional view with portions in elevation showing part of a conventional polishing apparatus in a polishing operation.

A polishing apparatus 1 having a configuration shown in FIG. 1 is typically used to polish a thin-plate-like object such as a semiconductor wafer (in the following description, a semiconductor wafer will be used consistently as an example of a thin-plate-like object to be polished). The polishing apparatus 1 is generally composed of a polishing surface table 2, a polishing head 5, and an abrasive supply hose 10.

For example, the polishing surface table 2 has a surface whose diameter is two times or more larger than that of a semiconductor wafer S. A polishing pad 3 made of, for example, polyester resin nonwoven fabric is fixed, that is, bonded, to the surface with an adhesive, for example, with a double-sided adhesive tape. The polishing surface table 2 is so configured as to rotate about a rotation axis 4 in a direction indicated by arrow Ra at 30 rpm, for example.

The polishing head 5 is fixed to a cylinder 7 via a rotary shaft 6 and disposed above the polishing surface table 2. The polishing head 5 is coaxial with the rotary shaft 6 and is rotated about an axis that is distant from the rotation axis 4 of the polishing surface table 2, for example, about an axis that is located at the midpoint of the radius of the polishing surface table 2, in the same rotation direction (indicated by arrow Rb) as the polishing surface table 2 at, for example, 30 rpm (i.e., at the same rotation speed as the polishing surface table 2).

An adhesion film 8 for holding the semiconductor wafer S, which also serves as a buffer member, is fixed to the bottom surface of the polishing head 5. To prevent the semiconductor wafer S from going out of place, a retainer ring 9 made of an epoxy resin or a polyacetal resin whose inner diameter is slightly larger than the outer diameter of the semiconductor wafer S is fixed to a peripheral portion of the surface of the adhesion film 8.

The abrasive supply hose 10, which is connected to an abrasive liquid supply apparatus, supplies an abrasive liquid L to the surface of the polishing pad 3 at a position close to the rotation center of the polishing surface table 2. The abrasive liquid L goes into the space between the polishing pad 3 and the semiconductor wafer S.

The adhesion film 8 is a polyurethane or polyester resin sheet of about 0.5 mm in thickness. The surface of the adhesion film 8 to contact the semiconductor wafer S is formed with minute sucker-like holes 8A, whereby the adhesion film 8 is given a function of holding the semiconductor wafer S by suction to prevent it from moving on the polishing head 5 during a polishing operation. Further, since the adhesion film 8 is elastic, it can absorb asperity, if any, due to unevenness in the thickness of the semiconductor wafer S or dust or the like sticking to the back surface of the semiconductor wafer S, thereby allowing the subject surface of the semiconductor surface to be polished uniformly.

To polish the semiconductor wafer S as an object, the semiconductor wafer S is held by the adhesion film 8 by water adhesion with a subject surface Sa placed outside (i.e., down). As shown in FIG. 1, the polishing head 5 is lowered in the direction indicated by arrow Z by operating the cylinder 7 in the state that the semiconductor wafer S is held in the above manner, whereby the semiconductor wafer S is pressed against the surface of the polishing pad 3 on the polishing surface table 2 with predetermined pressing force via the rotary shaft 6. The polishing surface table 2 is rotated in the direction indicated by arrow Ra at the above-mentioned rotation speed, and the polishing head 5 holding the semiconductor wafer S is rotated in the direction indicated by arrow Rb at the above-mentioned rotation speed. The abrasive liquid L is supplied to the surface of the polishing pad 3 through the abrasive supply hose 10. Chemical mechanical polishing (hereinafter abbreviated as "polishing") is thus performed on the subject surface Sa of the semiconductor wafer S by means of the polishing pad 3 and the abrasive liquid L.

Although during the polishing operation the rotation of the polishing head 5 and the polishing surface table 2 produces force of making the semiconductor wafer S go out of the surface of the polishing head 5, the retainer ring 9 prevents the semiconductor wafer S from doing so.

During a polishing operation, particularly immediately after its start, polishing friction resistance occurs between the semiconductor wafer S and the polishing pad 3, whereby shearing stress occurs between the semiconductor wafer S and the adhesion film 8. The holding force of the adhesion film 8 acting on the semiconductor wafer S is not necessarily uniform along the surface because of, for example, unevenness in the size and the density of the sucker-like holes 8A; there may exist portions where the holding force is strong and portions where it is weak. As the shearing stress increases, it is more concentrated on the portions where the holding force is strong, to cause very small distortions (asperity), which in turn cause unevenness of polishing in the subject surface Sa of the semiconductor wafer S.

If the polishing resistance is further increased and becomes so strong as to exceed the holding force of the adhesion film 8, the semiconductor wafer S is moved to collide with the retainer ring 9. Collisions may cause minute asperities on the surface of the semiconductor wafer S, to lower the uniformity of polishing. The semiconductor wafer S maybe broken by impact, or the retainer ring 9 may be destroyed by impact-induced fatigue failure, in which case the semiconductor wafer S goes out of the polishing head 5 and the polishing operation is disabled.

SUMMARY OF THE INVENTION

The present invention has been made to solve the above problems in the art, and an object of the invention is to increase the adhesion force by suction for holding an object of polishing such as a semiconductor wafer, to thereby provide a polishing apparatus which can polish an object with a high degree of uniformity in its subject surface.

To attain the above object, the invention provides a polishing apparatus for polishing a subject surface of a thin-plate-like object that is held by a polishing head with a polishing pad that is mounted on a surface of a polishing surface table, comprising sucking means provided in the polishing head; and a holding film provided on an object holding surface of the polishing head, the holding film being elastic and capable of passing air through itself.

DETAILED DESCRIPTION OF THE PREFERRED EMBODIMENT

A polishing apparatus according to an embodiment of the invention will be hereinafter described with reference to FIG. 2.

Figure 1:
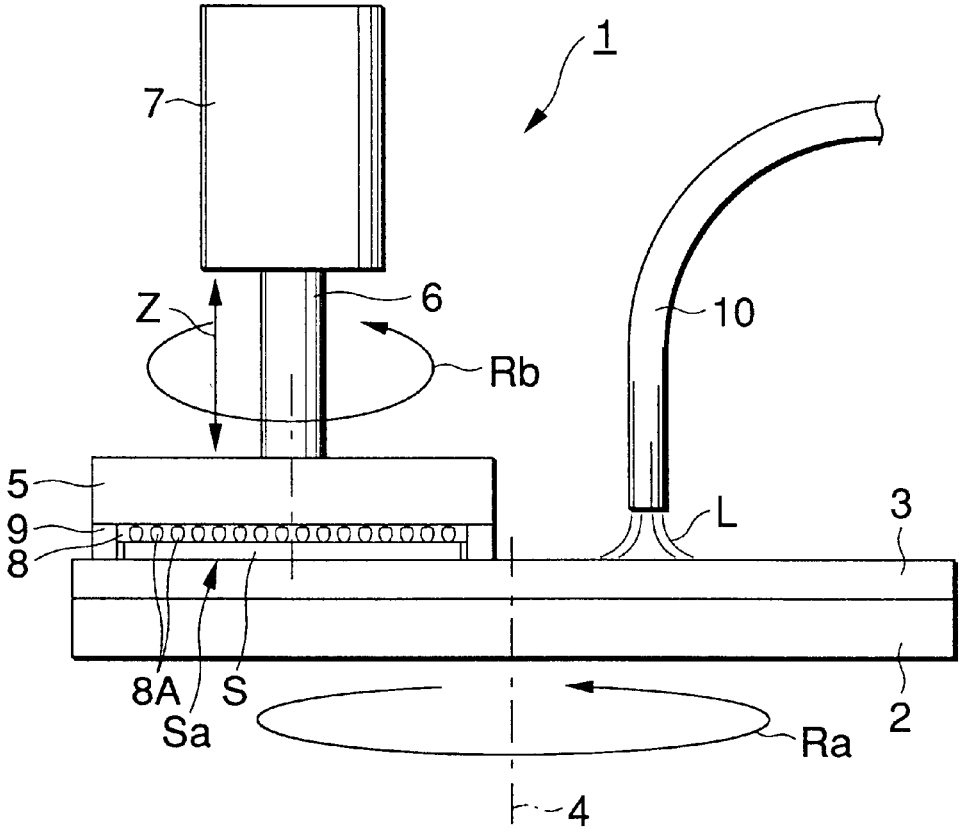
FIG. 1 is a sectional view with portions in elevation showing part of a conventional polishing apparatus in a polishing operation.
Figure 2:
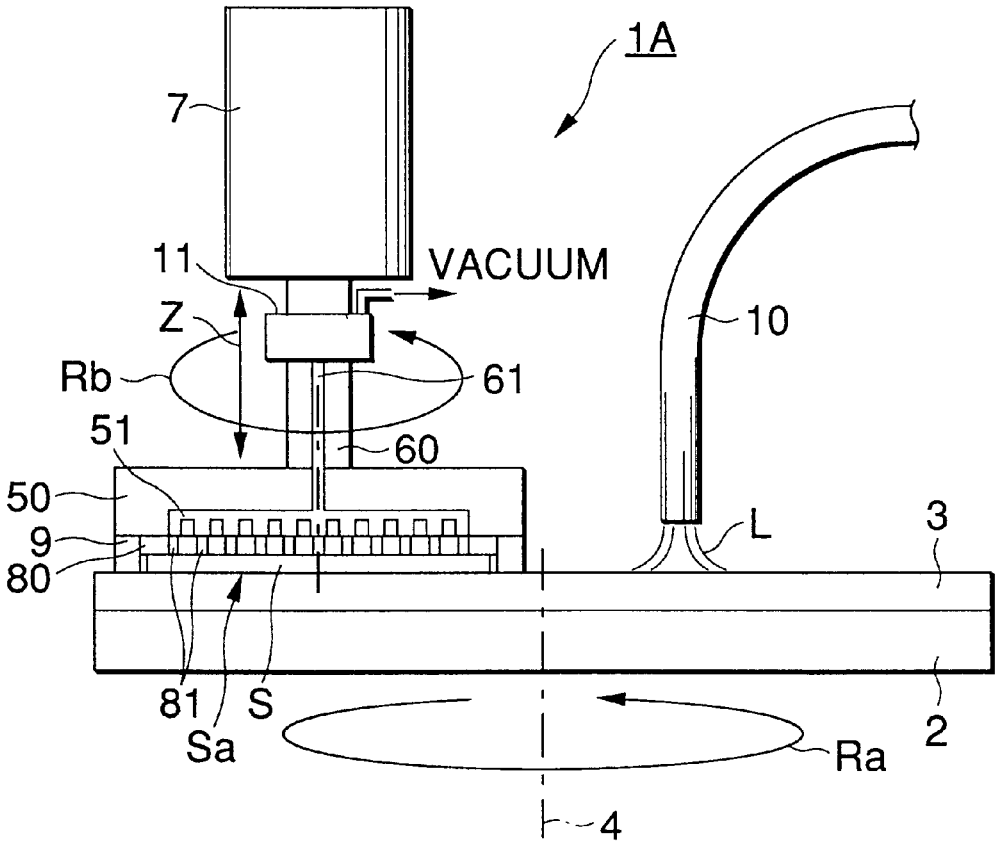
FIG. 2 is a sectional view with portions in elevation showing part of a polishing apparatus of the invention in a polishing operation.

FIG. 2 is a sectional view showing part of a polishing apparatus of the invention in a polishing operation. The components shown in FIG. 2 that are the same as those of the conventional polishing apparatus 1 shown in FIG. 1 are given the same reference numerals as the latter.

In FIG. 2, reference symbol 1A denotes the polishing apparatus of the invention. Since the polishing surface table 2 side structure of the polishing apparatus 1A is the same as that of the conventional apparatus 1, it will not be described below.

Like the polishing head 5 of the conventional apparatus 1, a polishing head 50 of the polishing apparatus 1A of the invention is disposed above the polishing surface table 2 and has a rotation axis that is spaced from the rotation axis 4 of the polishing surface table 2 and is located at, for example, the midpoint of the radius of the polishing surface table 2. The polishing head 50 is connected to the cylinder 7 via a rotary shaft 60 having a through-hole 61 whose center line coincides with the rotation axis and a rotary joint 11 that is formed with a through-hole (not shown) that is aligned with the through-hole 61. The rotary joint 11 is provided to connect the vacuum system of the rotating polishing head 50 to an external vacuum pump, for example. The polishing head 50 is rotated together with the rotary shaft 60 in the same rotation direction (indicated by arrow Rb) as the polishing surface table 2 at, for example, 30 rpm (i.e., at the same rotation speed as the polishing surface table 2).

The bottom surface of the polishing head 50 for holding a semiconductor wafer S as an object of polishing is formed with a plurality of suction grooves 51, which communicate with the through-hole 61 of the rotary shaft 60.

A perforated holding film 80, which also serves as a buffer member, is fixed, that is, bonded, to the bottom surface of the polishing head 50. A number of through-holes 81 are formed through the holding film 80 so as to communicate with the respective suction grooves 51 and, in turn, with the through-hole 61. The holding film 80 is a sheet of about 1.5 mm in thickness made of polyurethane, a polyester resin, or a synthetic rubber. If the holding film 80 is too hard, the semiconductor wafer s is adversely affected by unevenness in its thickness or dust or the like sticking to its back surface, to impair the uniformity of a polished (finished) subject surface of the semiconductor wafer S. If the holding film 80 is too soft, it is compressed by suction force, whereby it becomes uneven in thickness or its life is shortened because of fatigue failure that is caused by compressive force that is imposed repetitively. Therefore, it is desirable that the holding film 80 be made of a material having a modulus of longitudinal elasticity of 0.2–100 kgr/cm$^2$.

As in the case of the conventional polishing apparatus 1, to prevent the semiconductor wafer S that is held on the bottom surface of the polishing head 50 from going out of place during a polishing operation, an annular retainer ring 9 made of an epoxy resin whose inner diameter is slightly larger than the outer diameter of the semiconductor wafer S is formed on a peripheral portion of the bottom surface of the polishing head 50.

An abrasive supply hose 10, which is connected to an abrasive liquid supply apparatus, supplies an abrasive liquid L to the surface of the polishing pad 3 at a position close to the rotation center of the polishing surface table 2. The abrasive liquid L goes into the space between the polishing pad 3 and the semiconductor wafer S.

Next, the operation of the polishing apparatus 1A of the invention will be described.

To polish the semiconductor wafer S as an object, as shown in FIG. 2, a vacuum pump is operated, whereby the semiconductor wafer S to be polished is held by the holding film 80 that is attached to the bottom surface of the polishing head 50 by vacuum-sucking the semiconductor wafer S by suction force that is transmitted through the rotary joint 11, the through-hole 61 of the rotary shaft 60 and the suction grooves 51 of the polishing head 50. The semiconductor wafer S is held with its subject surface Sa placed outside (i.e., down).

Then, in the state that the semiconductor wafer S is held in the above manner, the cylinder 7 is operated to lower the polishing head 50 in the direction indicated by arrow Z, whereby the semiconductor wafer S is pressed against the surface of the polishing pad 3 of the polishing surface table 2 by predetermined pressing force via the rotary joint 11 and the rotary shaft 60.

At the same time, the polishing surface table 2 is rotated in the direction indicated by arrow Ra at the above-mentioned rotation speed, and the polishing head 50 holding the semiconductor wafer S is rotated in the direction indicated by arrow Rb at the above-mentioned rotation speed. Further, the abrasive liquid L is supplied to the surface of the polishing pad 3 through the abrasive supply hose 10. The subject surface Sa of the semiconductor wafer S is thus polished by means of the polishing pad 3 and the abrasive liquid L.

In the polishing apparatus 1A of the invention, since the polishing head 50 holds the semiconductor wafer S by vacuum suction force via the holding film 80 during a polishing operation, the holding force (adhesion force) becomes stronger than in the conventional polishing apparatus 1, whereby the semiconductor wafer S being held does not move on the polishing head 50. Further, stress as imposed on the adhesion film 8 by movement of the semiconductor wafer S in the conventional apparatus 1 does not act on the holding film 80 in the polishing apparatus 1A of the invention, and hence the life of the holding film 80 is elongated. Still further, since the semiconductor wafer S hardly moves on the polishing head 50, it rarely collides with the retainer ring 9, elongating the life of the retainer ring 9.

Although in the above embodiment the polishing head 50 is formed with a plurality of suction grooves 51, it is not always necessary to form grooves and a plurality of suction holes may be formed instead. As a further alternative, the polishing head 50 itself may be made of a porous material so as to allow passage of gases.

The structure of the holding film 80 that enables communication between the semiconductor wafer S and the polishing head 50 is not limited to the through-holes 81 and may be of any form. For example, a plurality of penetration slits may be formed.

As is apparent from the above description, in the polishing apparatus of the invention, an object of polishing does not move on the polishing head because it is held strongly by vacuum suction force. Therefore, no stress is imposed on the holding film, whereby the object can be polished with improved uniformity in its subject surface.

Further, since an object of polishing hardly moves, there does not occur an event that the object hits the retainer ring and damages it.

What is claimed is:

1. A polishing apparatus to polish a surface of a thin-plate object to be polished, the object having an object diameter, comprising:

(a) a polishing head having a head surface to hold the object to be polished;

(b) the head surface being grooveless and further having a plurality of holes extending through the polishing head dispersed substantially across the surface; and (c) a film disposed between the head surface and the object, the film further including a plurality of slits substantially dispersed throughout the film; and wherein the polishing head comprises a porous material capable of permitting suction to pass therethrough.

2. The polishing apparatus of claim 1, wherein the film comprises at least one of a polyurethane, polyester resin, and synthetic rubber material.

3. The polishing apparatus of claim 1, wherein the polishing head further comprises an annular ring having a ring diameter that is larger than the object diameter.

4. The polishing head of claim 1, wherein the polishing head comprises a porous material capable of permitting suction to pass therethrough; wherein the film comprises at least one of a polyurethane, polyester resin, apd synthetic rubber material; and wherein the polishing head further comprises an annular ring having a ring diameter that is larger than the object diameter.

5. A polishing apparatus for polishing a surface of a thin-plate object, the object having an object diameter, the apparatus comprising a polishing surface table with a polishing pad, a polishing pad head having the holding surface receiving a holding film for attaching the object to the polishing head, the apparatus further comprising the polishing head having suction means for providing a suction to the holding surface, the holding film being an elastic material and having a plurality of penetration slits through the film; the polishing head being porous to permit permeation of suction gases.

6. The polishing apparatus of claim 5, wherein the film comprises at least one of a polyurethane, polyester resin, and synthetic rubber material.

7. The polishing apparatus of claim 5, wherein the polishing head further comprises an annular ring having a ring diameter that is larger than the object diameter.

8. The polishing head of claim 5 wherein the film comprises at least one of a polyurethane, polyester resin, and synthetic rubber material; and wherein the polishing head further comprises an annular ring having a ring diameter that is larger than the object diameter.

9. A polishing apparatus for polishing a surface of a thin-plate object, the apparatus comprising a polishing surface table with a polishing pad, the polishing surface table being further adapted to rotate along a first rotational axis; a polishing pad head having the holding surface receiving a holding film for attaching the object to the polishing head, the polishing head further having a polishing head rotational axis, the polishing head rotational axis and first rotational axis are adjacent to each other, the polishing head having suction means for providing a suction to the holding surface, the holding film being an elastic material and having a plurality of penetration slits through the film; the polishing head being porous to permit permeation of suction gases; and a plurality of suction hole distributed substantially across a grooveless polishing head.

10. The polishing apparatus of claim 9, wherein the film comprises at least one of a polyurethane, polyester resin, and synthetic rubber material.

11. The polishing apparatus of claim 9, wherein the polishing head further comprises an annular ring having a ring diameter that is larger than the object diameter.

12. The polishing head of claim 9, wherein the film comprises at least one of a polyurethane, polyester resin, and synthetic rubber material; and wherein the polishing head further comprises an annular ring having a ring diameter that is larger than the object diameter.

* * * * *